US006056127A

United States Patent [19]

Low et al.

[11] Patent Number: 6,056,127

[45] **Date of Patent: *May 2, 2000**

[54] DELIVERY SYSTEM FOR SORTING APPARATUS

[75] Inventors: John Menzies Low, Hertford; Stewart John Mills, Cranham, both of United Kingdom

[73] Assignee: Sortex Limited, London, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,034

[22] Filed: Oct. 28, 1996

[51] Int. Cl.[7] ..... B07C 5/342

[52] U.S. Cl. ..... 209/639; 209/923; 209/580

[58] Field of Search ..... 209/639, 644, 209/587, 580, 581, 923, 922

[56] References Cited

U.S. PATENT DOCUMENTS

| | | | |
|---|---|---|---|
| 4,122,952 | 10/1978 | Richards | 209/587 |
| 4,203,522 | 5/1980 | Fraenkel et al. | 209/558 |
| 4,513,868 | 4/1985 | Culling et al. | 209/587 |
| 4,630,736 | 12/1986 | Maughan et al. | 209/587 |
| 4,699,273 | 10/1987 | Suggi-Liverani et al. | 209/580 |
| 5,236,092 | 8/1993 | Krotkov et al. . | |
| 5,315,384 | 5/1994 | Heffington et al. | 348/93 |
| 5,538,142 | 7/1996 | Davis et al. | 209/580 |
| 5,659,624 | 8/1997 | Fazzari et al. | 209/580 |
| 5,669,511 | 9/1997 | Satake et al. | 209/580 |

FOREIGN PATENT DOCUMENTS

| | | | |
|---|---|---|---|
| 0443769A2 | 8/1991 | European Pat. Off. . | |
| 2668962 | 5/1992 | France | 209/639 |

*Primary Examiner*—William E. Terrell
*Assistant Examiner*—Patrick Mackey
*Attorney, Agent, or Firm*—Majestic, Parsons, Siebert & Hsue

[57] ABSTRACT

Sorting apparatus has a delivery system for creating a stream of product pieces to be sorted in free flight at a sorting station where selected pieces are rejected from the stream. The system comprise a delivery conveyor inclined to the horizontal for receiving product and directing it towards the sorting station. The length of the delivery conveyor, its inclination and speed are selected to effectively create a low friction chute and establish a uniform, stable and constant velocity product stream for delivery to the sorting station.

28 Claims, 1 Drawing Sheet

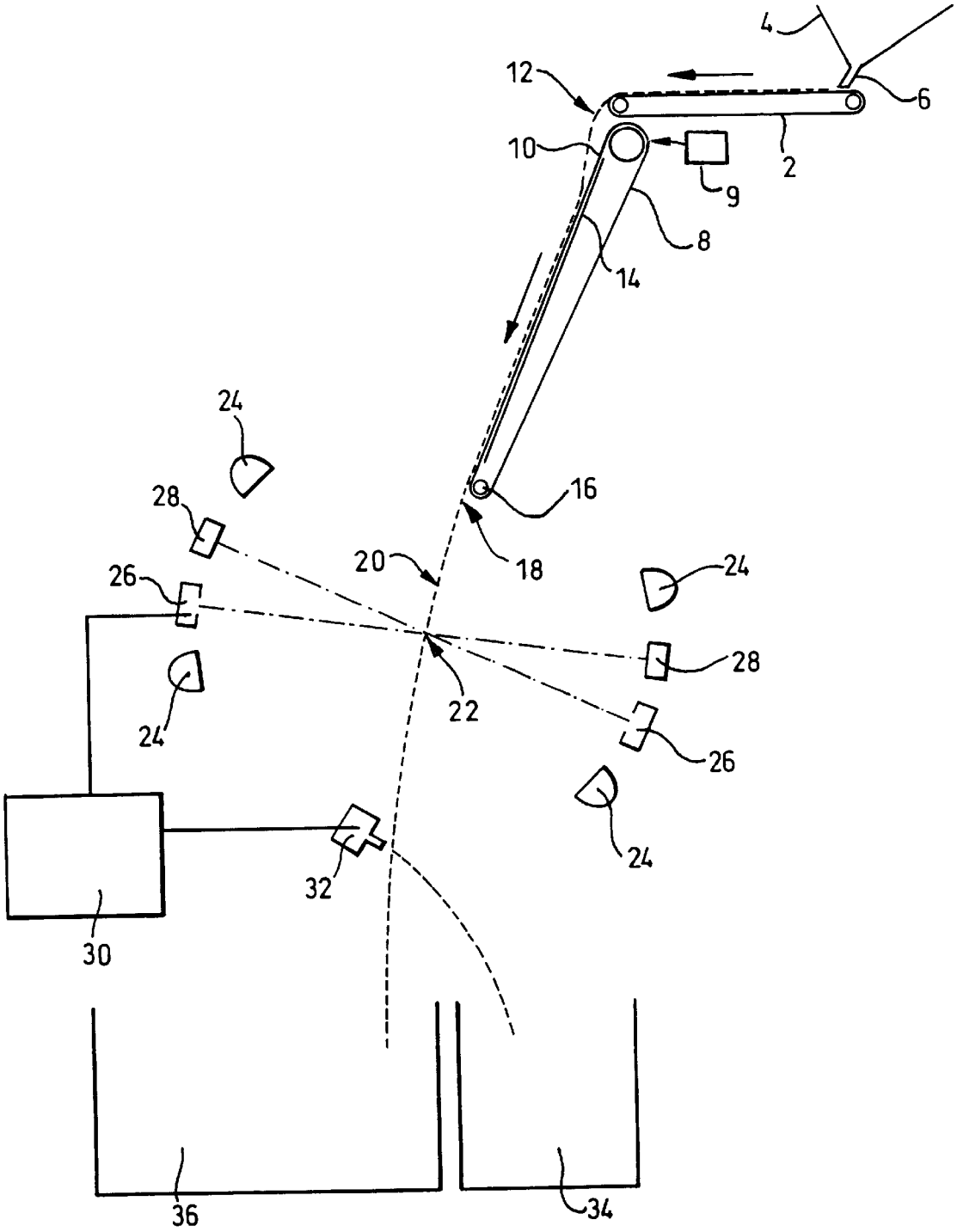
4
12
6
10
2
9
8
14
24
16
28
20
18
24
26
28
22
24
26
24
32
30
36
34

DELIVERY SYSTEM FOR SORTING APPARATUS

BACKGROUND TO THE INVENTION

This invention relates to sorting apparatus. It is particularly concerned with such apparatus which grades a stream of product in free flight according to colour characteristics, and activates an ejection mechanism based on that grading to remove selected product from the stream. The present invention is directed at a delivery system for creating the product stream in a form suitable for grading and sorting in this manner.

Product in free flight can be effectively graded using a variety of optical techniques. A basic technique is essentially monochromatic and classifies light reflected from product pieces as "dark" or "light". If the amount of "dark" exceeds a given threshold for a particular piece, then that piece is rejected. More sophisticated techniques monitor reflected light in different colours. Various sorting apparatus which grade product according to its ability to reflect light in different wavelength ranges are described in U.S. Pat. Nos. 4,203,522; 4,513,868; 4,699,273; and 5,538,142, the disclosures of which are incorporated herein by reference. In apparatus disclosed in the '522 and '142 Patents for example, detectors are responsive to light reflected from a product in different wavelength ranges, and generate signals indicative of different qualities of the product These signals are compared and analyzed, to generate a signal which can activate an ejector to remove the relevant item from the product stream.

In sorting apparatus of the kind described above it is of course important that the product stream is created in a form which enables items therein to be accurately graded and identified for ejection if appropriate. Normally, this stream is created by discharge from a chute, or from a horizontal or nearly horizontal conveyor driven at an appropriate speed. A chute is appropriate where the product to be graded is of generally consistent size and shape such as peas, coffee beans and rice. However, the relative movement between product and chute can generate static friction forces in the product which adversely affect the stream discharged therefrom, and any moisture in the product can also disrupt the uniformity of the flow. A conveyor system is normally preferred where product pieces of more widely varying size and moisture content are to be included in the stream, and the conveyor provides for the product to be stabilized on the belt before discharge into free flight. However, horizontal conveyors of the kind required to achieve the requisite stability in product moving at speeds of around 3 meters per second on the conveyor require a considerable space in which to operate effectively. Further, even at 3 meters per second, product can adhere to the conveyor at the point of discharge resulting in product not being discharged with a consistent trajectory, and thus not being properly graded. Additionally, the trajectory of the product stream from the conveyor means that an optical grading system will normally have components disposed above and below it, with the consequence that unwanted material in the stream can fall onto such components, resulting in improper functioning and inaccurate sorting.

SUMMARY OF THE INVENTION

The present invention is directed at sorting apparatus in which a delivery system for product to the product stream uses a conveyor system to exploit the stabilizing benefit of a moving support surface for product, in what is essentially a chute construction generally resulting in reduced lateral space requirements. More particularly, the system comprises a delivery conveyor oriented at an inclination to the horizontal with a belt section thereof directed upwardly to receive product. The conveyor is driven such that the belt section carrying product moves downwardly to discharge the product stream from the lower end thereof towards the sorting station at which the product is graded and sorted by ejection of selected product. The length, inclination and speed of the delivery conveyor are selected to establish substantially uniform and stable velocity in product pieces in the stream on discharge from the lower end of the conveyor. Typically, this speed is within 15%, preferably 10% of the vertical speed that would be reached at the height of the lower end of the delivery conveyor by product pieces in free tall from the point at which it is delivered to the conveyor Normally, the speed would be greater than the free fall vertical speed of product pieces such that its initial effect upon receiving product is to accelerate it towards the sorting station, but closer to the lower end of the conveyor, by which stage the product has accelerated under the force of gravity, the belt has a decelerating effect. For example, at the point of discharge, the belt speed might be up to 15%, preferably no more than 10%, slower than the speed of the product stream.

In order to achieve the above effects, the inclination of the delivery conveyor to the horizontal is normally at least 45°, and typically of the order of 60°. We have found that for a product stream comprising a range of vegetable products, a conveyor of approximately 1 meter in length, inclined at 60°, and driven at around 4 meters per second, results in the creation of a substantially uniform product stream moving at a stable velocity in free flight into the sorting zone.

Systems of the invention provide a stabilizing effect on the discharged product stream and also address problems posed by known apparatus relating to moisture and static friction forces. The movement of the conveyor reduces the chances of product adhering to the belt, but the relatively small but significant difference between the speeds of movement of the belt and of the product reduces the generation of static friction forces at the point of discharge. Thus, by proper selection of the system pentameters, a substantial improvement in the quality of the product stream can be achieved.

Because the product stream discharged from the delivery conveyor in apparatus according to the invention follows a trajectory having from the outset a substantial vertical component, the elements of the sorting station will be disposed laterally of that trajectory, rather than above and below it. As a consequence, any unwanted material or debris that falls out of the product steam in the sorting station or thereafter does not interfere with the optical units involved in the grading and sorting of products. Indeed, the optical units can be laterally spaced from the product stream by distances, in excess of 500 mm for example, which effectively preclude debris from the product stream from reaching them. This is of particular benefit in the sorting of product which has heretofore been suitable for sorting in discharge from a conveyor rather than a chute. A stream of such product is more likely to include unwanted material, such as water, and other debris.

The product that eventually forms the stream at the sorting station must of course be fed to the delivery conveyor. This can conveniently be accomplished on a feed conveyor for carrying products substantially horizontally from a source to an upper end section of the delivery conveyor. It is preferred that the product is fed to the delivery conveyor in the same direction as the horizontal component of the inclination of the delivery conveyor, and typically the product is fed over the upper end of the delivery conveyor such that any forward momentum at this first discharge point is away from rather than toward the respective belt section of the delivery conveyor. While the use of a feed conveyor is presently preferred, other mechanisms such as a vibratory feeder, can be used.

The operational speed of the delivery conveyor in apparatus according to the invention can be adjustable. However, depending upon the required versatility of a particular piece of apparatus, other parameters of the delivery system can additionally or alternatively be made variable.

BRIEF DESCRIPTION OF THE DRAWING

The accompanying schematic drawing illustrates diagrammatically, and by way of example, the operation of apparatus in accordance with the invention.

DESCRIPTION OF PREFERRED EMBODIMENT

The drawing shows a feed conveyor 2 which receives product from a hopper 4 down a chute 6. The conveyor 2 is driven such that its upper belt section moves from right to left as shown at a speed of normally no more than 1 meter per second to carry products to the top of a delivery conveyor 8. The delivery conveyor 8 is inclined to the horizontal at an angle of substantially 60°, and the upper end of the conveyor 8 is disposed beneath the discharge end of the feed conveyor 2, such that the feed conveyor 2 carries product over the upper end of the delivery conveyor 8. The upwardly facing belt section 10 of the delivery conveyor 8 receives product from the feed conveyor 2 at a first discharge point 12. The delivery conveyor 8 is driven by an appropriate drive means 9 such that the belt section 10 moves downwards and to the left as shown, thus carrying material in the same horizontal direction as it is borne on the feed conveyor 2. The belt section 10 is supported on a plate 14, and the face of the belt on the conveyor 8 which receives product from the conveyor 2 is preferably smooth. It may be formed from a variety of known plastics materials, PVC and polythene or polyurethane being appropriate. However, whatever material is used for the belt, at least the lower roller 16 around which the belt is driven is preferably of small radius such as a knife-edge roller, to assist in ensuring the smooth discharge at a second discharge point 18 of product from the delivery conveyor 8. The use of small rollers also avoids optical obstructions.

From the second discharge point 18, the product stream is in free flight as it passes through a sorting station at which product in the stream is graded, and then sorted by ejection of selected product therefrom.

Reference numeral 20 indicates the region in which a product in the product stream 22 is graded, and from which selected product is subsequently ejected. Region 20 is illuminated from the left and right as shown by light sources 24, and product in the region 20 reflects light which is received in the scanning assemblies 26. Region 20 is also illuminated from both sides as shown, by background light sources 28, and light from the sources 28 is also received in the scanning assemblies 26. The assemblies 26 monitor light reflected from product in the stream 22, and generate signals indicative of the quality of each product item, which signals are transmitted to a computer 30, which determines according to its programme whether a particular item is acceptable. If it is not, then the computer 30 instructs the battery of ejectors 32 to remove that particular item from the stream 22 by the delivery of an air pulse. Such a removed item is deflected from the path of the stream 22 into a reject receptacle 34. The remainder of the stream continues towards an accept receptacle 36.

As can be seen from the drawing, the trajectory of the product stream 22 from the second discharge point 18 is predominantly vertical. The scanning assemblies 26 and the light sources 24 and 28 are disposed on either side thereof, at a substantial distance. As a consequence there is little risk of unwanted material or debris in the original product stream making contact with this equipment and thereby interfering with the sorting process. This feature of apparatus according to the invention is of particular value when the product being sorted contains items with a significant moisture content, as moisture can of course significantly alter the characteristics of an optical system.

The sorting technique described above is effective for a wide range of products. Other sorting techniques may be used in addition to or as an alternative to the one described, and reference is directed to U.S. Pat. No. 5,538,142 for a discussion of some such alternatives.

In order to ensure that the sorting station in the apparatus described above can operate at maximum efficiency, a substantially uniform product stream should be created, moving at a stable velocity at least from the second discharge point and through the sorting station. To achieve this, the length of the delivery conveyor 8 and its inclination and driving speed must be selected accordingly. For a given piece of apparatus both the width and length of the delivery conveyor would be normally fixed, and a typical length is around 1 meter. The width is also normally around 1 meter. While its inclination and driven speed may be adjusted, normally these parameters would be chosen for the product being sorted such that the belt speed has initially an accelerating effect on product arriving at the first discharge point, and a decelerating effect on product at the point of departure from the delivery conveyor 8 at the second discharge point With the delivery conveyor 8 inclined to the horizontal at angle in the range 50 to 70°, we have found that a belt speed within around 15% of the vertical speed that would be reached by a product in free fall from the first discharge point, is appropriate. Normally the belt speed would be lower than such free fall velocity, although there are circumstances in which speeds higher than that free fall velocity would be appropriate. For product streams comprising a vegetable selection, we found a belt speed of approximately 4 meters per second to be appropriate; less than the respective free fall velocity, but only by around 10%. In a specific example, with its inclination at 60°, the delivery conveyor was driven with a belt speed of 3.7 meters per second, and a stream of vegetable product pieces was seen to discharge at 4 meters per second.

The embodiments of the invention described above are given by way of example only, and illustrate various ways the invention can be put into effect. Variations can be made, and alternative equipment can be used without departing from the spirit and scope of the invention claimed.

We claim:

1. Sorting apparatus having a sorting station and a delivery system for creating a stream of product pieces to be sorted in free flight at the sorting station where selected pieces are ejected from the stream, the delivery system comprising a delivery conveyor including a conveyor belt oriented at an inclination of at least 45° to the horizontal; means for feeding product pieces to an upper end section of said conveyor belt; and means for driving the conveyor belt such that a section thereof carrying product pieces moves in a downward direction toward the sorting station, the length of the conveyor, its inclination and speed being selected to establish a speed of discharge for product pieces from the delivery conveyor belt substantially equal to the vertical speed reached by pieces in free fall through the vertical length of the conveyor belt from its upper end to its lower discharge end.

2. Apparatus according to claim 1 including a feed conveyor for carrying product pieces substantially horizontally from a source to said upper end section of the delivery conveyor belt section.

3. Apparatus according to claim 2 wherein the feed conveyor is oriented to carry product pieces in the same direction as the horizontal component of the inclination of the delivery conveyor.

4. Apparatus according to claim 2 or claim 3 wherein the feed conveyor extends over the upper end of the delivery conveyor.

5. Apparatus according to claim 1 wherein the speed of the delivery conveyor is such that said belt section moves at a speed less than the discharge velocity of product pieces therefrom.

6. Apparatus according to claim 5 wherein the belt speed does not exceed a level that is 15% less than said product discharge velocity.

7. Apparatus according to claim 5 wherein the belt speed does not exceed a level that is 6% less than said product discharge velocity.

8. Apparatus according to claim 1 wherein the speed of the delivery conveyor is such that said belt section moves at a speed substantially equal to the vertical speed that would be reached at the height of the lower end of the delivery conveyor by product pieces in free fall from said upper end section of the delivery conveyor.

9. Apparatus according to claim 1 wherein the sorting station comprises means for illuminating product pieces passing therethrough; means for analysing light reflected from said pieces; and means for ejecting from the product stream those pieces not satisfying predetermined criteria for such analysed light.

10. Sorting apparatus having a sorting station and a delivery system for creating a stream of product pieces to be sorted in free flight at the sorting station where selected pieces are ejected from the stream, the delivery system comprising a feed conveyor for carrying product pieces substantially horizontally from a source to a first discharge point; a delivery conveyor including a conveyor belt for receiving product pieces at said first discharge point, the delivery conveyor belt being oriented at an inclination to the horizontal of at least 45°, and including means for driving an upwardly facing belt section thereof disposed substantially below the first discharge point in a downward direction to a second discharge point at the lower end thereof at a speed within 15% of the vertical speed that would be reached at the height of the second discharge point by product pieces in free fall from the first discharge point.

11. Apparatus according to claim 10 wherein the inclination of the delivery conveyor to the horizontal is substantially 60°.

12. Apparatus according to claim 1 or claim 10 wherein the inclination and speed of the delivery conveyor are adjustable.

13. A method of sorting product pieces comprising the steps of:

(a) feeding said product pieces to the upper end of a belt section of a delivery conveyor inclined by a least 45° to the horizontal and driven with said belt section moving in a downward direction to discharge said pieces in a product stream to a sorting station, the product pieces being in free flight at the sorting station;

(b) setting the inclination and speed of the delivery conveyor to establish a substantially uniform and stable stream of product pieces discharged therefrom with said pieces moving at a speed substantially equal to that reached by said pieces in free fall from said upper end of said belt section;

(c) analysis said product pieces in free flight in the sorting station to differentiate between acceptable and selected said pieces; and (d) ejecting selected pieces from the product stream.

14. A method according to claim 13 wherein said product is fed to the delivery conveyor along a feed conveyor aligned with the delivery conveyor.

15. A method according to claim 13 wherein the delivery conveyor is driven at a speed within 15% of the vertical speed that would be reached at the height of the lower end of the delivery conveyor by the product piece in free fall from the upper end of the delivery conveyor.

16. Sorting apparatus comprising a delivery conveyor belt from which belt a stream of product pieces to be sorted is discharged in free flight to a sorting station where selected pieces are ejected, the conveyor belt being inclined to the horizontal and the drive means being from one upper end section to a lower discharge section; means for driving the conveyor belt; and inclination of the conveyor being selected such that product received at its upper end section is initially accelerated in its downward motion, and its length being selected to stabilise the stream of product discharged at the discharge section.

17. Apparatus according to claim 16 wherein the length, inclination and speed of the conveyor are selected to establish a speed of discharge for product pieces at the discharge section within 15% of the vertical speed reached by pieces in free fall through the vertical length of the conveyor belt from its upper end section to its lower discharge section.

18. Apparatus according to claim 16 wherein the length, inclination and speed of the conveyor are selected to establish a speed of discharge for product pieces at the

19. Apparatus according claim 16 wherein the conveyor belt drive means drives the conveyor belt at a speed within 15percent of the vertical speed that would be reached at the height of the lower discharge section in free fall from the upper end section thereof.

20. Apparatus according to claim 16 wherein the inclination of the conveyor belt is at least 45°.

21. Sorting apparatus comprising a delivery conveyor belt from which belt a stream of product pieces to be sorted is discharged in free flight to a sorting station where selected pieces are ejected, the conveyor belt being oriented at an inclination to the horizontal of at least 45° and the drive means being coupled to the belt such that the section thereof facing upwards for receiving product pieces is driven from an upper end section to a lower discharge section; means for driving the conveyor belt at a speed within 15 percent of the vertical speed that would be reached at the height of the lower discharge section in free fall from the upper end section thereof; and a feed conveyor for feeding product pieces substantially horizontally to said upper end section of the conveyor belt.

22. A method of sorting product pieces comprising the steps of:

a) feeding said product pieces to an upper end section of a delivery conveyor belt inclined to the horizontal and driven with an upward facing section thereof receiving and carrying said product pieces moving in a downward direction to a lower discharge section, said product pieces being discharged into free flight at the discharge section to a sorting station;

b) setting the speed and inclination of the conveyor belt such that product received at its upper end section is initially accelerated in its downward motion, and to stabilise the stream of product discharged at the discharge section.

c) analysing said product pieces in free flight in the sorting station to differentiate between acceptable and selected ones of said pieces; and d) ejecting said selected pieces from the product stream.

23. Apparatus for sorting product pieces, comprising:

a sorting station, a conveyor belt inclined at an angle with the horizontal to receive the product at an upper end section and discharge the product at a lower end section in a free falling stream through the sorting station, a product feed device that deposits the product on the conveyor belt at its upper end section, a motor connected to drive the conveyor belt at a controlled speed from its upper end section to its lower end section, and wherein the length, angle of incline and the controlled speed of the conveyor belt are such that the belt accelerates the product deposited by the product feed device at the upper end section of the conveyor belt and decelerates the product at the lower end section of the conveyor belt, thereby to form the product pieces into a controlled stream that is discharged from the discharge end of the conveyor belt in free flight through the sorting station.

24. Apparatus according to claim 23, wherein the controlled speed at which the conveyor belt is driven by the motor drive is less than but within 15 percent of a vertical speed that would be reached at the lower end section of the conveyor belt by product free falling from a height of the uppend section of the conveyor belt.

25. Apparatus according to claim 23, wherein the angle of incline of the conveyor belt with the horizontal is at least 45 degrees.

26. Apparatus according to claim 23, wherein the product feed device deposits the product on the conveyor belt by dropping the product particles on the conveyor belt upper end section.

27. Apparatus according to claim 23, wherein the product feed device includes a above the upper end section of the conveyor belt.

28. Apparatus according to claim 23, wherein the sorting station includes a source of illumination of the product pieces passing therethrough, an analyzer of the illumination after interacting with the product pieces, and an ejector that removes from the product stream those pieces whose analyzed interacting light fails to satisfying a predetermined criteria.

* * * * *